US011161715B2

(12) United States Patent
Studer et al.

(10) Patent No.: US 11,161,715 B2
(45) Date of Patent: Nov. 2, 2021

(54) ELEVATOR SYSTEM WITH DISCARDED BELT AS COMPENSATION ELEMENT FOR COMPENSATING THE UNLADEN WEIGHT OF THE SUPPORTING MEANS

(71) Applicant: Inventio AG, Hergiswil (CH)

(72) Inventors: Christian Studer, Kriens (CH); Andrea Cambruzzi, Zürich (CH)

(73) Assignee: INVENTIO AG, Hergiswil NW (CH)

( * ) Notice: Subject to any disclaimer, the term of this patent is extended or adjusted under 35 U.S.C. 154(b) by 191 days.

(21) Appl. No.: 16/341,097

(22) PCT Filed: Oct. 17, 2017

(86) PCT No.: PCT/EP2017/076388
§ 371 (c)(1),
(2) Date: Apr. 11, 2019

(87) PCT Pub. No.: WO2018/077654
PCT Pub. Date: May 3, 2018

(65) Prior Publication Data

US 2020/0189881 A1 Jun. 18, 2020

(30) Foreign Application Priority Data

Oct. 31, 2016 (EP) ..... 16196584

(51) Int. Cl.
*B66B 7/06* (2006.01)

(52) U.S. Cl.
CPC ..... *B66B 7/068* (2013.01)

(58) Field of Classification Search
CPC ..... B66B 7/068
See application file for complete search history.

(56) References Cited

U.S. PATENT DOCUMENTS 3,768,596 A * 10/1973 Solymos ..... B66B 7/068 187/254
4,230,205 A * 10/1980 Darwent ..... B66B 7/068 187/265
4,716,989 A * 1/1988 Coleman ..... B66B 7/068 187/404
5,117,945 A * 6/1992 Honda ..... B66B 7/068 187/264
6,364,063 B1 * 4/2002 Aulanko ..... D07B 5/006 187/266

(Continued)

FOREIGN PATENT DOCUMENTS

CN 2646108 Y 10/2004
CN 2714510 Y 8/2005

(Continued)

*Primary Examiner* — Michael A Riegelman
(74) *Attorney, Agent, or Firm* — William J. Clemens; Shumaker, Loop & Kendrick, LLP

(57) ABSTRACT

An elevator system includes a car and a counterweight which are connected to one another via a support element. The elevator system has a compensation element for compensating the weight of the support element, wherein this compensation element includes at least one belt. The at least one belt was previously used as a support element for a car of an elevator system. A method for recycling support elements of elevator systems uses the discarded support elements as the compensation element in an elevator system.

12 Claims, 2 Drawing Sheets

(56) References Cited

U.S. PATENT DOCUMENTS

| | | | | |
|---|---|---|---|---|
| 6,837,340 | B2 * | 1/2005 | Strauss | B66B 7/068 187/266 |
| 9,790,054 | B2 * | 10/2017 | Alasentie | B66B 7/068 |
| 2004/0055831 | A1 * | 3/2004 | Huber | B66B 7/068 187/412 |
| 2008/0223665 | A1 * | 9/2008 | O'Donnell | B66B 7/062 187/256 |
| 2012/0067674 | A1 * | 3/2012 | Legeret | B66B 17/12 187/404 |
| 2013/0048431 | A1 * | 2/2013 | Grossrieder | B66B 7/068 187/251 |
| 2019/0322491 | A1 * | 10/2019 | Christen | B66B 19/00 |
| 2020/0189881 | A1 * | 6/2020 | Studer | B66B 7/068 |

FOREIGN PATENT DOCUMENTS

| | | | |
|---|---|---|---|
| CN | 1882497 | A | 12/2006 |
| CN | 103466408 | A | 12/2013 |
| EP | 2881354 | A1 | 6/2015 |

* cited by examiner

ELEVATOR SYSTEM WITH DISCARDED BELT AS COMPENSATION ELEMENT FOR COMPENSATING THE UNLADEN WEIGHT OF THE SUPPORTING MEANS

FIELD

The invention relates to an elevator system comprising a car, a counterweight and at least one support means, the support means at least partly supporting the car and the counterweight, and the car and the counterweight being interconnected by means of the support means. The elevator system further comprises a compensating element for compensating for the weight of the support means.

BACKGROUND

In elevator systems, a counterweight is usually provided for compensating for the weight of the car and the loads that can be received in the car. The counterweight is connected to the car by means of the support means by which the car and the counterweight are supported, and moves in the elevator shaft in a manner complementary to the car. The support means is in particular steel cables or belts.

The weight of the counterweight is aligned with the weight of the car in a predetermined ratio. This is intended to ensure that the forces to be applied by the motor of the elevator system for moving the car are minimized, and that the traction between the support means and the disks by which the support means is guided is sufficient in order to avoid the cable slipping on the discs.

In elevator systems having a small lifting height, in this case the weight of the support means itself is negligible in the compensation, since the weight of the support means is significantly smaller than the weight of the car or the counterweight.

In elevator systems having a large lifting height, however, suitably long support means are required, and therefore the unladen weight thereof cannot be negligible in the compensation. In particular when the elevator car is arranged in one of the end positions, i.e. either at the bottom or at the top of the elevator shaft, and thus the entire weight of the support means is arranged on one side, it may be the case in high elevator systems that the weight of the support means is actually significantly greater than the weight of the elevator car and of the counterweight.

In order to compensate for this variable distribution of the non-negligible weight of the support means on the car side and counterweight side of the elevator system, it is customary to provide elevators with a compensating element for compensating for the weight of the support means.

In known elevators, in particular compensating chains or compensating cables made of steel are used which are fastened to the car and to the counterweight and thus form a closed loop together with the support means, such that the sum of the respective weights of the support means and the compensating element on the car side and on the counterweight side are approximately the same, and thus the elevator system is balanced again.

The known compensating cables and compensating chains for compensating for the weight of the support means are disadvantageous in that elements that are specifically produced for this purpose are used, as a result of which the material requirements, production costs and logistics outlay are increased.

An elevator system comprising belt-like compensating cables is known from US 2004/055831 A1.

SUMMARY

One object of the invention is that of providing an elevator system and a compensating element for compensating for the weight of a support means of such an elevator system, which are constructed in a simple manner with few materials. A further object of the invention is that of providing a method for recycling support means of elevator systems, by means of which compensating elements for elevator systems can be produced in a simple and cost-effective manner.

According to the invention, the elevator system has a car, a counterweight, and a support means which at least partly supports the car and the counterweight and by means of which the car and the counterweight are interconnected. The support means may in particular be one or more cables and/or one or more belts. The support means is guided in particular by means of one or more rollers, at least one of said rollers being drivable by a motor such that the car, and thus also the counterweight that is rigidly coupled to the car, are movable within the elevator shaft by means of the motor.

A compensating element for compensating for the unladen weight of the support means is also provided, the compensating element comprising at least one belt. The belt used as the compensating element is a discarded belt that was previously used as a support means for a car of an elevator system. A discarded belt is understood to mean in particular a belt that was previously used as a support means in an elevator system and was discarded as part of routine maintenance and removed from the elevator system accordingly. In particular, the belt may have been discarded due to reaching a maximum permitted age and/or reaching a maximum permitted number of bending cycles.

Recycling of the discarded belts is achieved by said belts no longer being used as safety-related support means, but instead as compensating elements, which are exposed to considerably less strain than the support means, and therefore do not have to meet demands that are as high. The belts therefore do not have to be disposed of, but can be reused for another purpose, as a result of which expensive compensating cables or compensating chains do not have to be produced. This reduces the effort, and costs are minimized. In addition, the use of materials is reduced and the environment is protected by the recycling.

In a preferred embodiment, the compensating element comprises at least two belts which extend in parallel with one another and lie on top of one another.

In a particularly preferred embodiment, the compensating element has a predetermined number of belts which extend in parallel with one another and lie on top of one another, the number being determined such that the weight of the compensating element per unit of length is equal to the weight of the support means per the same unit of length. This ensures that the weight of the compensating element and the support means always balances out, irrespective of the position of the car inside the elevator shaft. The belts lying on top of one another and extending in parallel with one another is understood to mean in particular that the belts lie on top of one another by means of their planar, in particular flat or profiled, sides.

The belts of the compensating element are in particular interconnected such that they cannot slip against one another, and are thus held in the predetermined position thereof. The belts can be interconnected in particular by means of a cold or hot laminating process. This results in particular in a secure bonded connection between the different belts. By melting the belts, in particular the profiled sides of the belts can also be interconnected, since the profiles are preferably at least partly flattened. Additionally, or alternatively, the belts may also be fused, bonded and/or riveted together. In this way, a secure, simple and cost-effective connection can be achieved between the scrapped belts and a compensating element.

In particular, all the belts which are interconnected so as to form a compensating element are discarded belts that were previously used as support means, and therefore no or only small amounts of new materials need to be used, and virtually the entire compensating element consists only of recycled elements. Alternatively, a mixture of discarded and new belts, or also only new, i.e. unused, belts can be interconnected so as to form a compensating element.

In a particularly preferred embodiment, the compensating element is arranged both on the car and on the counterweight, in particular in each case on the underside, i.e. the side facing the shaft bottom when the elevator system is mounted as intended, of the car or of the counterweight. In this case, the compensating element can either hang freely within the shaft and/or can be fastened to the bottom of the elevator shaft by means of a tensioning device, in particular a spring-mounted tensioning device, such that the compensating element is always under tension.

In a particularly preferred embodiment of the invention, the compensating element comprises a predetermined number of belts which extend in parallel with one another and lie on top of one another, the number being determined such that the weight of the compensating element per unit of length is equal to the weight of the support means per unit of length, and the belts of the compensating element being interconnected.

A further aspect of the invention relates to a compensating element for compensating for the weight of a support means of an elevator system, the compensating element comprising at least one discarded support means that was previously used as a support means for a car of an elevator system. This ensures that the compensating elements do not need to be produced, specifically and cost-intensively, from new raw materials, but rather the discarded support means can thus be reused as a compensating element and can thus be recycled.

The discarded support means of the compensating element is in particular a discarded belt that was previously used as a support means for a car of an elevator system.

Instead of a belt, or in addition to at least one belt, the discarded support means of the compensating element may also be a discarded cable that was previously used as a support means for a car of an elevator system.

In a particularly preferred embodiment of the invention, the compensating element comprises in particular a plurality of discarded cables that were previously used as support means for cars of elevator systems. This means that the discarded support means cables can also now be reused as a compensating element. The use of cables is advantageous over belts in that fewer cables have to be interconnected since the cables inherently have a greater unladen weight per unit of length than the conventional belts.

The number of cables interconnected so as to form the compensating element is in particular in turn selected such that the weight of the compensating element per unit of length is equal to the weight per the same unit of length of the support means of an elevator system for which the compensating element is intended.

The cables may in particular be interwoven with one another so as to form the compensating element. Alternatively, other ways of interconnecting the cables are also conceivable, for example by bonding and/or welding.

A further aspect of the invention relates to an elevator system comprising a car, a counterweight and a support means, the support means interconnecting the car and the counterweight and at least partly supporting same. The elevator system further comprises at least one above-described compensating element for compensating for the counterweight of the support means.

A further aspect of the invention relates to a method for recycling support means of elevator systems, in which used support means which have at least partly supported a car and/or a counterweight of an elevator system are removed from the elevator system, in particular because they have reached a maximum number of permitted bending cycles and/or a maximum permitted age.

At least two used support means are then interconnected in order to achieve a predetermined weight per unit length. The element resulting from connecting the used support means is then used as a compensating element in an elevator system for compensating for the weight of the support means of said elevator system.

Said elevator system need not be the same elevator system in which the used support means, now being used as a compensating element, were also previously used as support means.

In particular, the used support means, which are interconnected so as to form the compensating element, are discarded belts that were previously used as support means in an elevator system.

DESCRIPTION OF THE DRAWINGS

Additional features and advantages of the invention are provided in the following description, which describes the invention in greater detail on the basis of the attached figures, in which.

DETAILED DESCRIPTION

Figure 1:
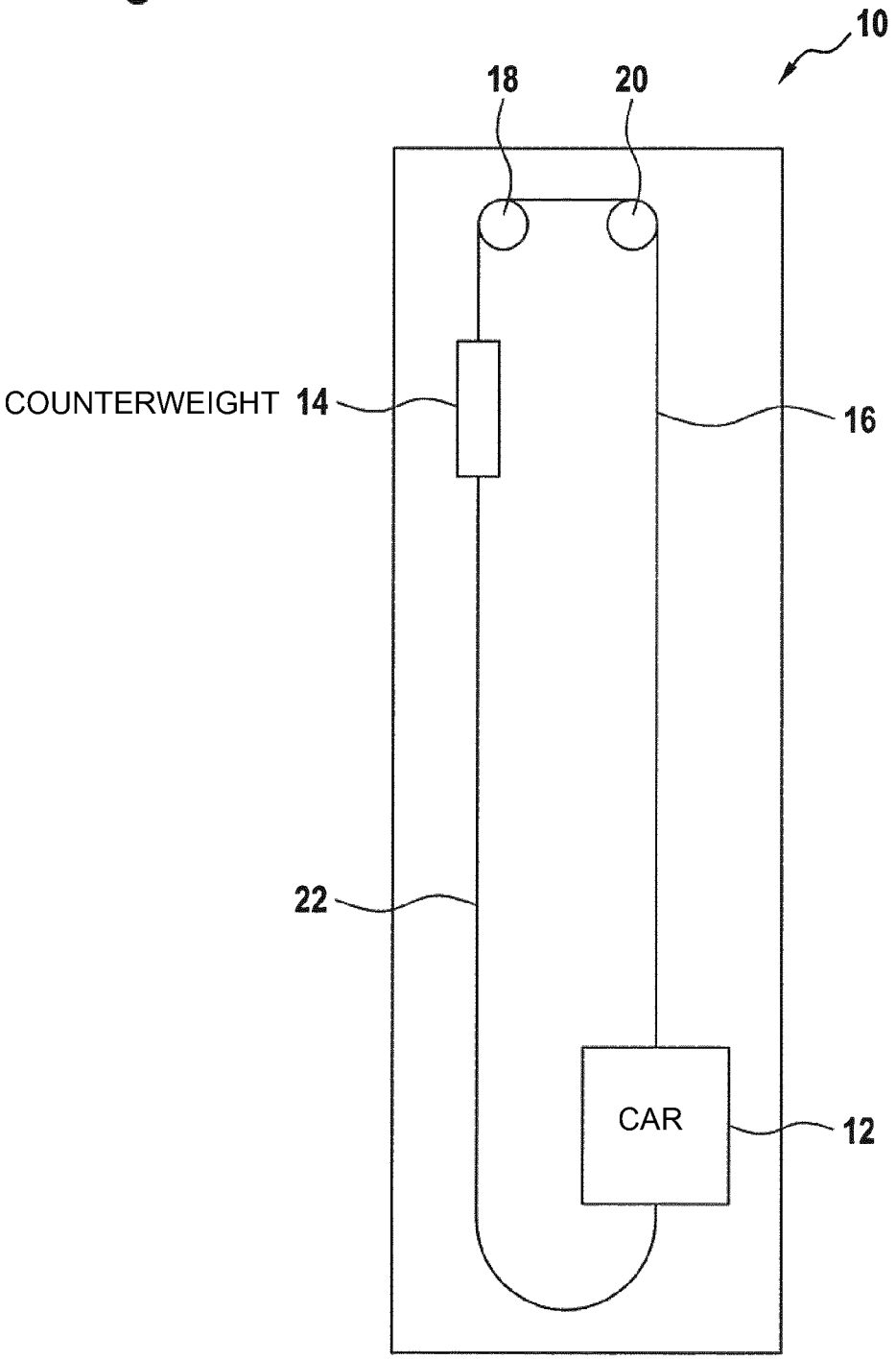
FIG. 1 is a schematic perspective view of an elevator system.

FIG. 1 is a schematic perspective view of an elevator system 10. The elevator system 10 comprises a car 12 and a counterweight 14 which are interconnected by means of a support means or element 16. The support means 16 comprises in particular a cable or a plurality of cables, in particular cables made of steel and/or synthetic fibers. Alternatively, or in addition, the support means 16 can also have one or more belts, each belt having in particular a plurality of cables which are embedded in a common sheath made of a plastics material.

In the embodiment shown in FIG. 1, the support means 16 is guided by means of two rollers 18, 20, of which at least one can be driven using a motor (not shown), such that the car 12, and accordingly the counterweight 14 in opposition, can be moved within the elevator shaft of the elevator system 10. In an alternative embodiment of the invention, the support means 16 may also be guided by means of more or fewer than two rollers 18, 20. Furthermore, in an alternative embodiment of the invention, different to that shown in FIG. 1, there is not a single, but rather a double suspension of the car 12 and the counterweight 14 on the support means 16. In this case, in particular the support means 16 can be guided through beneath the bottom of the car 12.

Depending on the position of the car 12 and, accordingly, of the counterweight 14 within the elevator shaft, a portion, of variable length, of the support means 16 is located either on the side of the car 12 or the side of the counterweight 14 with respect to the two rollers 18 and 20, such that, on account of the unladen weight of the support means 16, the balancing is not ensured without additional auxiliary measures. In order to compensate for the unladen weight of the support means 16, a compensating element 22 is therefore provided which is fastened to the car 12 and to the counterweight 14. A closed loop is formed by said compensating element 22 together with the support means 16, such that the total weight resulting from the support means 16 and the compensating element 22 is always approximately the same both on the side of the car 12 and on the side of the counterweight 14, and therefore the balancing of the elevator system 10 is independent of the position of the car 12 and the counterweight 14.

Figure 2:
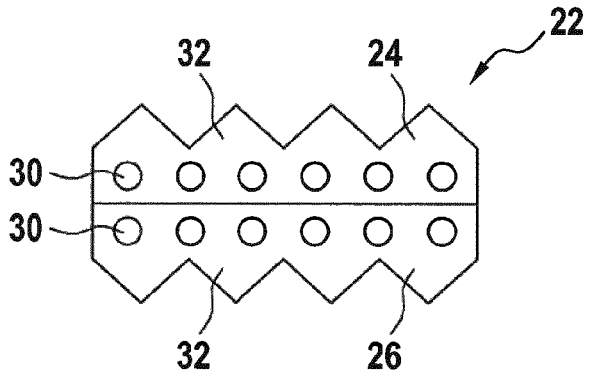
FIG. 2 is a schematic perspective view of a compensating element of the elevator system from FIG. 1 according to a first embodiment.

FIG. 2 is a schematic sectional view of such a compensating element 22 according to a first embodiment of the invention. In this first embodiment of the invention, the compensating element 22 comprises two belts 24, 26 which extend in parallel with one another, which lie on top of one another and which are interconnected. In particular, the belts 24, 26 may be fused together, laminated onto one another, bonded together and/or riveted together such that their relative positions to one another are fixed, and they form a single compensating unit 22. The belts 24, 26 are in particular old, used, discarded belts that were previously used as support means for supporting an elevator car and/or a counterweight within an elevator system, and have been removed from said elevator system. Such used, discarded belts are in particular understood to mean belts 24, 26 which, due to reaching a maximum number of bending cycles and/or a maximum age, no longer ought to be used as support means and have thus been removed from the elevator system. Additionally, or alternatively, belts of this kind which, despite not yet having reached their maximum number of bending cycles and/or their maximum age, have been removed from elevator systems for other reasons, for example when elevator systems are modernized, may also be recycled as a compensating element 22.

This allows the belts 24, 26 to be recycled, and therefore the compensating element 22 does not have to be produced from new belts or other components, but instead only elements which would otherwise be discarded and disposed of are used.

This reduces the use of new materials, and costs are minimized. In addition, the environment is protected.

Each of the belts 24, 26 has a plurality of cables, in particular steel cables, one of which is designated by way of example by reference sign 30 in each case. Said cables are embedded in a sheath 32 so as to be completely encased, said sheath 32 consisting in particular of a plastics material, preferably polyamide.

In the embodiment shown in FIG. 2, the two belts 24, 26 are interconnected in such a way that they are interconnected by their flat sides, that is to say the sides that do not have profile grooves by means of which the belts 24, 26, when used as support means, otherwise run from the rollers 18, 20 in correspondingly complementary belts.

Figure 3:
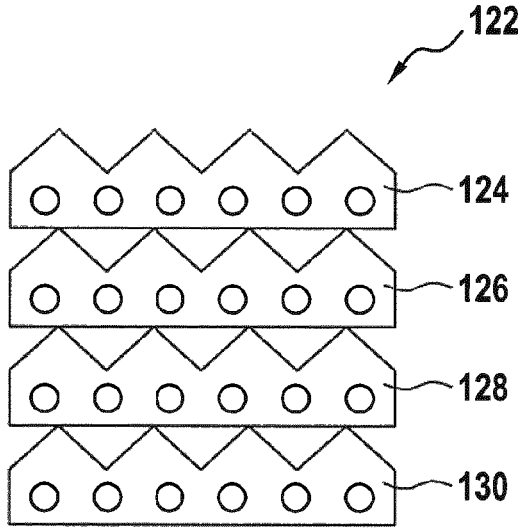
FIG. 3 is a schematic perspective view of a compensating element of the elevator system from FIG. 1 according to a second embodiment.

FIG. 3 shows a compensating element 122 according to a second embodiment, in which not only two belts, but a total of four belts 124, 126, 128 and 130 lie on top of one another and are interconnected.

In an alternative embodiment of the invention, more or fewer than four belts, for example three or five belts, are interconnected so as to form a compensating element 22, 122. In particular, the number of belts 124 to 130 which are interconnected so as to form the compensating element 122 are selected such that the resulting weight per meter corresponds to the weight per meter of the support means 16 of the elevator system 10 in which the compensating element 22, 122 is intended to be used for compensation.

If the support means 16 of the elevator system 10 has a plurality of belts, the compensating element 22, 122 has in particular the same number of belts.

Figure 4:
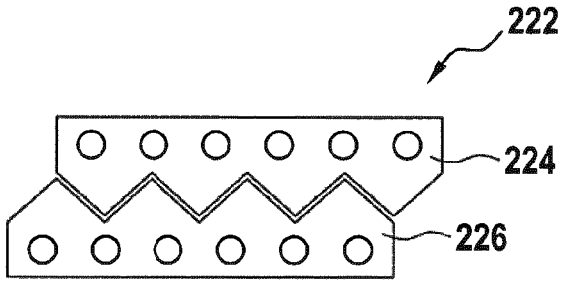
FIG. 4 is a schematic perspective view of a compensating element of the elevator system from FIG. 1 according to a third embodiment.

In an alternative, third embodiment of a compensating element 222, shown in FIG. 4, the two belts 224, 226 can also lie on top of one another by means of their profiled sides. Alternatively, it is also possible for the flat side of one belt to be in contact with the profiled side of the other belt.

In an alternative embodiment of the invention, the compensating element 22, 122, 222 may also comprise one or more discarded cables which are interconnected. This allows in particular recycling also of discarded cables, previously used as support means, as a compensating element 22, 122, 222, and therefore the cables do not have to be needlessly thrown away, but can be reused even after reaching their maximum permitted service life for the use as support means and/or after reaching the maximum permitted number of bending cycles for the use as support means.

In a further alternative embodiment of the invention, the compensating element 22, 122, 222 may also comprise both at least one belt and at least one cable, in particular a discarded belt and a discarded cable.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

10 Elevator system
12 Car
14 Counterweight
16 Support means
18, 20 Rollers
22, 122, 222 Compensating element
24, 26, 124 to 130, 224, 226 Belts
30 Cable
32 Sheath

The invention claimed is:

1. An elevator system comprising:

an elevator car;

a counterweight;

a support means that at least partly supports the car and the counterweight and interconnects the car with the counterweight; and a compensating element compensating for a weight of the support means, the compensating element including a belt being a discarded belt that was previously used as another support means either for the elevator car and the counterweight of the elevator system or for another elevator car and another counterweight of another elevator system.

2. The elevator system according to claim 1 wherein the compensating element has at least two of the belt, wherein the belts extend in parallel with one another and lie on top of one another.

3. The elevator system according to claim 1 wherein the compensating element has a predetermined number of the belt that extend in parallel with one another and lie on top of one another, and wherein the number is predetermined such that a weight of the compensating element per a unit of length is equal to a weight of the support means per the unit of length.

4. The elevator system according to claim 1 wherein the compensating element has at least two of the belt that extend in parallel with one another and lie on top of one another and the belts are interconnected.

5. The elevator system according to claim 4 wherein the belts are at least one of laminated onto one another, fused together, bonded together and riveted together.

6. The elevator system according to claim 1 wherein the compensating element is fastened to the car and to the counterweight.

7. A compensating element for compensating for a weight of a support means of an elevator system, comprising: at least one discarded support means that was previously used as another support means either for a car of the elevator system or for another car of another elevator system.

8. The compensating element according claim 7 wherein the at least one discarded support means is a discarded belt that was previously used as the another support means.

9. The compensating element according claim 7 wherein the at least one discarded support means is a discarded cable that was previously used as the another support means.

10. The compensating element according to claim 7 wherein the at least one discarded support means includes a plurality of discarded, interconnected cables that were previously used as the another support means.

11. The compensating element according to claim 10 wherein the cables are interwoven.

12. An elevator system comprising:

an elevator car;

a counterweight;

at least one support means that at least partly supports the car and the counterweight and interconnects the car with the counterweight; and the compensating element according to claim 7 interconnecting the car with the counterweight.

* * * * *